US008576138B2

(12) United States Patent
Suzuki et al.

(10) Patent No.: US 8,576,138 B2
(45) Date of Patent: Nov. 5, 2013

(54) ANTENNA UNIT HOUSED IN AN OUTSIDE MIRROR

(75) Inventors: Hiroshi Suzuki, Tokyo (JP); Tsutomu Ito, Tokyo (JP); Akira Yoneya, Tokyo (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 497 days.

(21) Appl. No.: 12/709,691

(22) Filed: Feb. 22, 2010

(65) Prior Publication Data

US 2010/0245188 A1 Sep. 30, 2010

(30) Foreign Application Priority Data

Mar. 31, 2009 (JP) ..... 2009-084367
Sep. 25, 2009 (JP) ..... 2009-220475

(51) Int. Cl.
*H01Q 1/42* (2006.01)
*H01Q 1/32* (2006.01)

(52) U.S. Cl.
USPC ..... 343/872; 343/713

(58) Field of Classification Search
None
See application file for complete search history.

(56) References Cited

U.S. PATENT DOCUMENTS

| | | | | |
|---|---|---|---|---|
| 5,757,327 | A | 5/1998 | Yajima et al. | |
| 6,639,568 | B1 * | 10/2003 | Hartmann | 343/892 |
| 7,059,897 | B2 * | 6/2006 | Smith et al. | 439/527 |
| 7,339,538 | B2 | 3/2008 | Yoneya et al. | |
| 7,609,217 | B2 * | 10/2009 | Noro et al. | 343/713 |
| 8,235,716 | B2 * | 8/2012 | Lemchen | 433/24 |
| 2006/0022881 | A1 * | 2/2006 | Yegin et al. | 343/713 |
| 2006/0214861 | A1 | 9/2006 | Nakajima et al. | |
| 2006/0238429 | A1 * | 10/2006 | Yoneya et al. | 343/713 |
| 2006/0244667 | A1 | 11/2006 | Thompson et al. | |
| 2006/0279468 | A1 * | 12/2006 | Yoneya et al. | 343/713 |
| 2007/0103374 | A1 * | 5/2007 | Lindackers et al. | 343/713 |
| 2008/0055184 | A1 | 3/2008 | Noro et al. | |
| 2008/0129620 | A1 | 6/2008 | Zurowski et al. | |

FOREIGN PATENT DOCUMENTS

| | | | |
|---|---|---|---|
| JP | 10-329615 | A | 12/1998 |
| JP | 2006-140956 | A | 6/2006 |
| JP | 2006-237917 | A | 9/2006 |
| JP | 2006-237951 | A | 9/2006 |
| JP | 2006-245719 | A | 9/2006 |
| JP | 2008-061084 | A | 3/2008 |
| JP | 2008-078901 | A | 4/2008 |

OTHER PUBLICATIONS

Extended European Search Report dated Aug. 23, 2010 (in English) issued in counterpart European Application No. 10153425.3.
Japanese Office Action dated May 11, 2011 (and English translation of relevant part thereof) in counterpart Japanese Application No. 2009-220475.

* cited by examiner

*Primary Examiner* — Trinh Dinh
(74) *Attorney, Agent, or Firm* — Holtz, Holtz, Goodman & Chick, PC

(57) ABSTRACT

In an antenna unit including a dome-shaped top cover, an antenna module disposed in the top cover and adapted to receive radio waves, a bracket covering an under surface of the top cover, and a gasket disposed between the top cover and the bracket to thereby ensure hermeticity in the top cover, the bracket includes a bottom portion pressure welding the gasket between the bottom portion and the top cover to make inside of the top cover an enclosed space, and a mounting portion integrated to the bottom portion to enable the antenna unit to mount in a narrow-mounting-space cabinet.

11 Claims, 13 Drawing Sheets

ANTENNA UNIT HOUSED IN AN OUTSIDE MIRROR

This application is based upon and claims the benefit of priority from Japanese Patent Application No. 2009-084367, filed on Mar. 31, 2009, and Japanese Patent Application No, 2009-220475, filed on Sep. 25, 2009, the disclosures of which are incorporated herein in their entirety by reference.

BACKGROUND OF THE INVENTION

This invention relates to an antenna unit for receiving satellite signals transmitted from artificial satellites and, in particular, relates to an antenna unit mounted in a narrow-mounting-space cabinet such as a cabinet for an outside mirror of an automobile.

Various antenna units for receiving satellite signals transmitted from artificial satellites have been proposed. For example, such antenna units include a GPS antenna unit for receiving GPS signals transmitted from GPS satellites and a SDARS antenna unit for receiving SOARS signals transmitted from SDARS satellites.

For instance, in recent years, the so-called global positioning system has been spreading in which a receiver receives signal waves transmitted respectively from a plurality of artificial satellites orbiting the earth and the current position of the receiver itself is detected based on information included in the received signal waves. This system is generally called a GPS (Global Positioning System) in those countries such as Japan and USA. The GPS generally uses GPS satellites controlled by the US Department of Defense. As similar systems, there are "GALILEO" used in Europe and "GLONASS" used in Russia. Herein, a positioning system using artificial satellites, the artificial satellites used in the positioning system, signal waves transmitted from the artificial satellites, receivers for receiving the signal waves, and so on are referred to as a GPS, GPS satellites, GPS signals, GPS receivers, and so on, respectively, for convenience sake.

The GPS is capable of detecting a current position of a GPS receiver itself with high accuracy and substantially in real time. Accordingly, the GPS is mainly used such that a GPS receiver is mounted in a moving object such as an automobile, an airplane, or a portable telephone and the current position of the moving object is measured.

Presently, GPS receivers that are suitable when installed in automobiles, i.e. so-called car GPS receivers, are rapidly spreading. When installing the GPS receiver in the automobile, a GPS receiving antenna unit for receiving GPS signals is often disposed outside the automobile, for example, on a roof.

On the other hand, the SDARS (Satellite Digital Audio Radio Service) is a radio service according to a digital radio broadcasting using artificial satellites (which will called "SDARS satellites" hereinafter) in the United States of America. That is, in recent years, a digital radio receiver, which receives the satellite wave from the SDARS satellites or the terrestrial wave so as to listen to the digital radio broadcasting, has been developed and is put to practical use in the United States of America. Specifically, two broadcasting stations called XM and Sirius provide radio programs on 250 or more channels in total. The digital radio receiver is generally mounted on a mobile object such as an automobile and is adapted to receive a radio wave having a frequency of about 2.3 gigahertz (GHz) as a received wave to listen to the digital radio broadcasting. In other words, the digital radio receiver is a radio receiver capable of listening to mobile broadcasting. Inasmuch as the received wave has the frequency of about 2.3 GHz, a reception wavelength (resonance frequency) $\lambda$ thereof is equal to about 128.3 mm. It is noted here that the terrestrial wave is a radio wave obtained by receiving the satellite wave at a ground station, slightly shifting the frequency of the satellite wave, and retransmitting the linear polarized wave. Thus, the terrestrial wave is the linear polarized wave exhibiting linear polarization while the satellite wave is a circular polarized wave exhibiting circular polarization.

An XM satellite radio antenna apparatus normally serves to receive circular polarized radio waves from two stationary satellites and, in an insensitive zone of the circular polarized waves, receives a radio wave by using a terrestrial linear polarization portion of the radio antenna apparatus. On the other hand, a Sirius satellite radio antenna apparatus normally serves to receive circular polarized radio waves from three orbiting satellites (synchronous type) and, in the insensitive zone, receives a radio wave by a terrestrial linear polarization portion of the radio antenna apparatus.

As described above, the radio wave having the frequency of about 2.3 GHz is used in the digital radio broadcasting. Therefore, an antenna for receiving the radio wave is often located outside as known in the art. If the digital radio receiver is mounted in the mobile object such as the automobile, the antenna unit is often attached to a roof of the mobile object (car body).

Various such antenna units for receiving the satellite signals transmitted from the artificial satellites have been proposed. For example, Japanese Patent No. 431-4486, which will be called Patent Document 1, discloses an antenna unit which is capable of easily positioning a packing member to a top cover. In addition, Japanese Unexamined Patent Publication Tokkai No. 2006-245719, namely, JP-A 2006-245719 (which corresponds to U.S. Pat. No. 7,339,538), which will be called Patent Document 2, discloses an antenna unit that is excellent in assembly performance which assembling the antenna unit. Furthermore, Japanese Unexamined Patent Publication Tokkai No. 2006-237951, namely, JR-A 2006-237951, which will be called Patent Document 3, discloses an antenna unit which is capable of improving a waterproofing function. Such as antenna units mounted on the outside such as the roof of the mobile object will be later called "roof-mounted antenna units."

On the other hand, Japanese Unexamined Patent Publication Tokkai No. 2008-78901, namely, JP-A 2008-78901, which will be called Patent Document 4, discloses an antenna unit which is housed in an outside mirror of an automobile. Such an antenna unit housed in the outside mirror of the automobile will later be called an "outside mirror housed antenna unit." Inasmuch as the outside mirror has an open/close structure for opening and closing the outside mirror against a car body of the automobile, a lot of pars such as a motor drive, a motor, and so on are housed in the outside mirror. Therefore, a gap which is capable of using in the cabinet of the outside mirror is very narrow. That is, the cabinet of the outside mirror is a cabinet having a narrow mounting space that will later be called a "narrow-mounting-space cabinet."

In such an outside mirror housed antenna unit, a waterproofing mechanism is required because the outside mirror is weather-damaged. Hence, it is considered that the roof-mounted antenna unit disclosed in the above-mentioned Patent Documents 1-3 is used in as the outside mirror housed antenna unit. However, the roof-mounted antenna unit requires a permanent magnet for fixing the roof-mounted antenna unit in question to the roof of the automobile by magnetic attraction while the outside mirror housed antenna unit does not require the permanent magnet. On the other hand, the outside mirror housed antenna unit requires a bracket for mounting the outside mirror housed antenna unit in question in the cabinet of the outside mirror.

In the manner which will later be described in conjunction with FIG. 1, in an antenna unit related to this invention, a gasket is sandwiched between a top cover and a bottom plate and is pressure inserted therein by securing the gasket using three screws. Thereafter, the bracket is mounted to the bottom plate using a plurality of screws. Therefore, the related antenna unit is disadvantageous in that the number of parts is increased and the number for mounting is increased.

SUMMARY OF THE INVENTION

It is therefore an exemplary object of the present invention to provide an antenna unit which is capable of decreasing the number of parts.

It is another exemplary object of the present invention to provide an antenna unit which is capable of decreasing the number for mounting.

Other objects of this invention will become clear as the description proceeds.

On describing the gist of an exemplary aspect of this invention, it is possible to be understood that an antenna unit comprises a dome-shaped top cover, an antenna module disposed in the top cover and adapted to receive radio waves, a bracket covering an under surface of the top cover, and a gasket disposed between the top cover and the bracket to thereby ensure hermeticity in the top cover. According to the exemplary aspect of this invention, the bracket comprises a bottom portion pressure welding the gasket between the bottom portion and the top cover to make inside of the top cover an enclosed space, and a mounting portion integrated to the bottom portion to enable the antenna unit to mount in a narrow-mounting-space cabinet.

BRIEF DESCRIPTION OF THE DRAWINGS

FIGS. 4A to 4D are views showing the antenna unit illustrated in FIG. 3, wherein FIG. 4A is a plan view of the antenna unit, FIG. 4B is a front view of the antenna unit, FIG. 4C is a right side view of the antenna unit, and FIG. 4D is a bottom view of the antenna unit;

FIGS. 5A to 5B are sectional views showing the antenna unit illustrated in FIG. 3, wherein FIG. 5A is a sectional view taken along line A-A in FIG. 4A, FIG. 5B is a sectional view taken along line B-B in FIG. 4A.

FIGS. 9A to 9G are views showing a packing member used in the antenna unit illustrated in FIG. 3, wherein FIG. 9A is a plan view of the packing member, FIG. 9B is a front view of the packing member, FIG. 9C is a right side view of the packing member, FIG. 9D is a rear view of the packing member, FIG. 9E is a bottom view of the packing member, FIG. 9F is a sectional view taken along line A-A in FIG. 9A, and FIG. 9G is a sectional view taken along line B-B in FIG. 9A;

FIGS. 10A to 10C are views showing a top cover used in the antenna unit illustrated in FIG. 3, wherein FIG. 10A is a bottom view of the top cover, FIG. 10B is a sectional view taken along line A-A in FIG. 10A, and FIG. 10C is a sectional view taken along line B-B in FIG. 10A;

FIG. 11A is a bottom view, and FIG. 11B is a sectional view taken along line B-B in FIG. 11A;

FIGS. 12A to 12D are views showing a bracket used in the antenna unit illustrated in FIG. 3, wherein FIG. 12A is a plan view of the bracket, FIG. 12B is a front view of the bracket, FIG. 12C is a right side view of the bracket, and FIG. 12D is a bottom view of the bracket;

DESCRIPTION OF THE PREFERRED EMBODIMENTS

Figure 1:
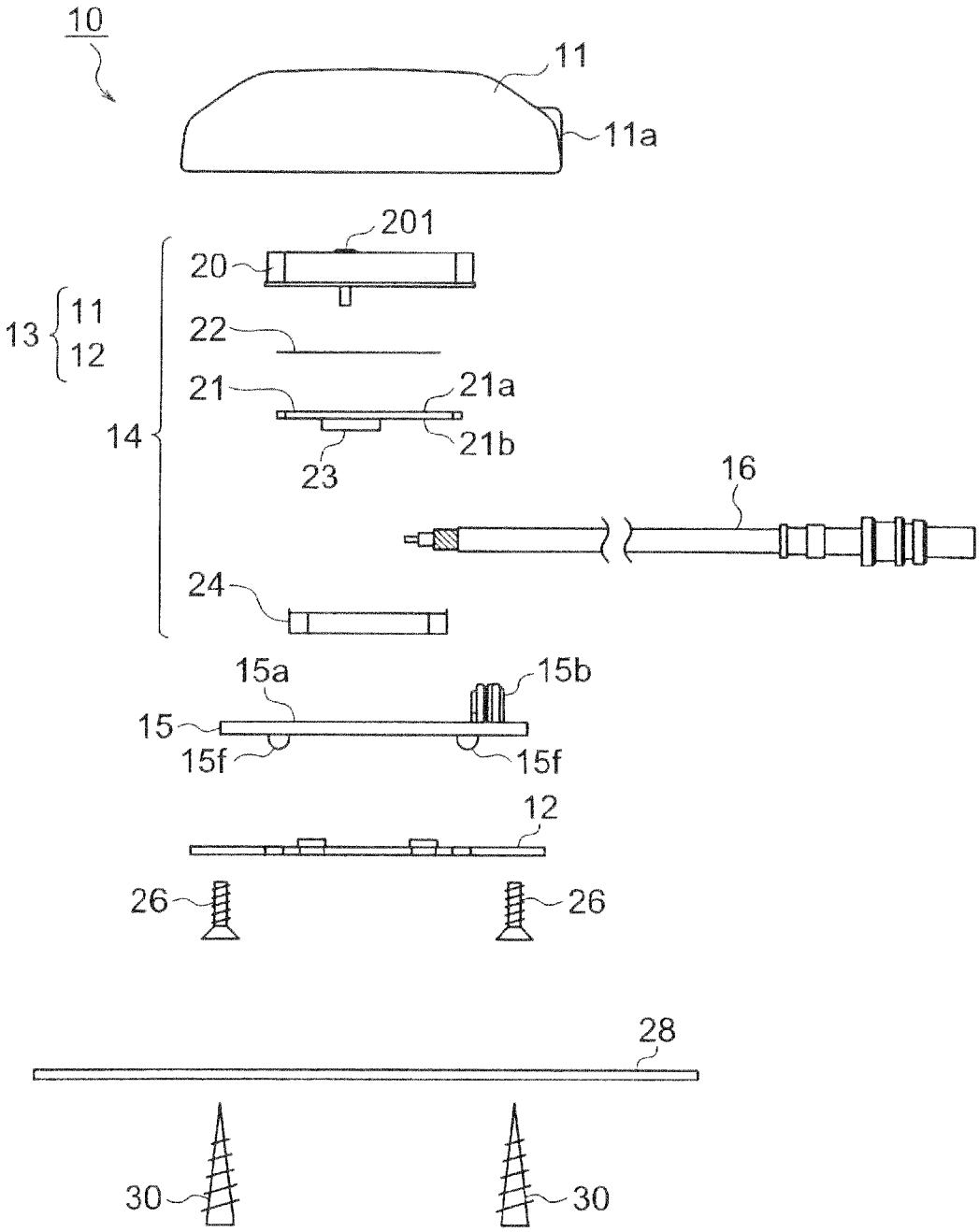
FIG. 1 RELATED ART
FIG. 1 is a schematic exploded view showing an antenna unit related to this invention.

Referring to FIG. 1, an outside mirror housed antenna unit 10 related to this invention will be described at first in order to facilitate an understanding of the present invention. The related outside mirror housed antenna unit 10 diverts a roof-mounted antenna unit disclosed in the above-mentioned Patent Documents 1-3. The illustrated antenna unit 10 comprises an antenna unit for receiving GPS signals.

The antenna unit 10 comprises an antenna case 13, an antenna module 14, a packing member (a gasket) 15, and a signal line (a coaxial cable) 16. The antenna case 13 is composed of a dome-shaped top cover 11 and a bottom plate 12. The antenna module 14 is disposed in the top cover 11. The packing member (the gasket) 15 is disposed between the top cover 11 and the bottom plate 12 to thereby ensure adhesiveness of the antenna case 13. Inasmuch as the packing member (the gasket) 15 also serves a waterproofing function, the packing member (the gasket) 15 is also called a waterproof packing. The signal line (the coaxial cable) 16 is connected to the antenna module 14.

The antenna module 14 comprises an antenna element 20 and a circuit board 21. The antenna element 20 is formed with an antenna for receiving the GPS signals transmitted from GPS satellites. The illustrated antenna element 20 comprises a patch antenna element. The circuit board 21 has a rear surface (a lower surface) 21*b* which is formed with a circuit (hereinafter referred to as a "signal processing circuit") 23 adapted to perform various signal processing such as signal amplification with respect to a GPS signal received by the antenna element 20. The antenna element 20 and an upper surface 21*a* of the circuit board 21 are bonded together by the use of a double-sided adhesive tape 22 or the like.

Connected to the circuit board 21, the signal line (the coaxial cable) 16 outputs the GPS signal to the outside of the antenna case 13. Further, to the rear surface (the lower surface) 21*b* of the circuit board 21, a shield case 24 for shielding the signal processing circuit 23 is attached. The signal line (the coaxial cable) 16 is drawn out to the outside through a cutout portion 11*a* formed at the top cover 11.

The antenna unit 10 is assembled by fixing the top cover 11 and the bottom plate 12 together by screwing the use of three screws 26 (two screws alone are illustrated in FIG. 1) in the state where the antenna module 14 and the packing member (the gasket) 15 are disposed in an inner space of the top cover 11.

The packing member (the gasket) 15 is made, for example, of a resin material such as a silicone rubber. The packing member (the gasket) 15 comprises a base portion 15*a* covering the whole surface of the antenna module 14 and a gasket portion 15*b* covering the outer periphery of the signal line (the coaxial cable) 16 at a position of the cutout portion 11*a* formed at the top cover 11

In the manner which is described above, the packing member (the gasket) 15 is sandwiched between the top cover 11 and the bottom plate 12 and is tightened by the use of the three screws 26. Therefore, the packing member (the gasket) 15 is pressure inserted therein to serve the waterproofing function.

Although the waterproofing function is served by pressure inserting the packing member (the gasket) 15 by the use of the three screws 26 in the example being illustrated, the waterproofing function is not restricted to it. For example, the waterproofing function may be served by pressure inserting the packing member (the gasket) 15 by the use of adhesive agent or welding as a substitute for the use of the three screws 26.

In addition, a bracket 28 is mounted and fixed to the bottom plate 12 by the use of a plurality of screws 30. And, by using the bracket 28, the antenna unit 10 is mounted in the inside of a cabinet of an outside mirror for an automobile.

Although the bracket 28 is mounted to the bottom plate 12 by the use of the plurality of screws 30 in the example being illustrated, the bracket 28 may be mounted to the bottom plate 12 by the use of a double-sided adhesive tape.

In the related antenna unit 10 illustrated in FIG. 1, the gasket 15 is sandwiched between the top cover 11 and the bottom plate 12 and is pressure inserted therein by securing the gasket 15 using the three screws 26. Thereafter, the bracket 28 is mounted to the bottom plate 12 by the use of the plurality of screws 30. Therefore, the related antenna unit 10 is disadvantageous in that the number of parts is increased and the number for mounting is increased, as mentioned in the preamble of the instant specification.

Figure 2:
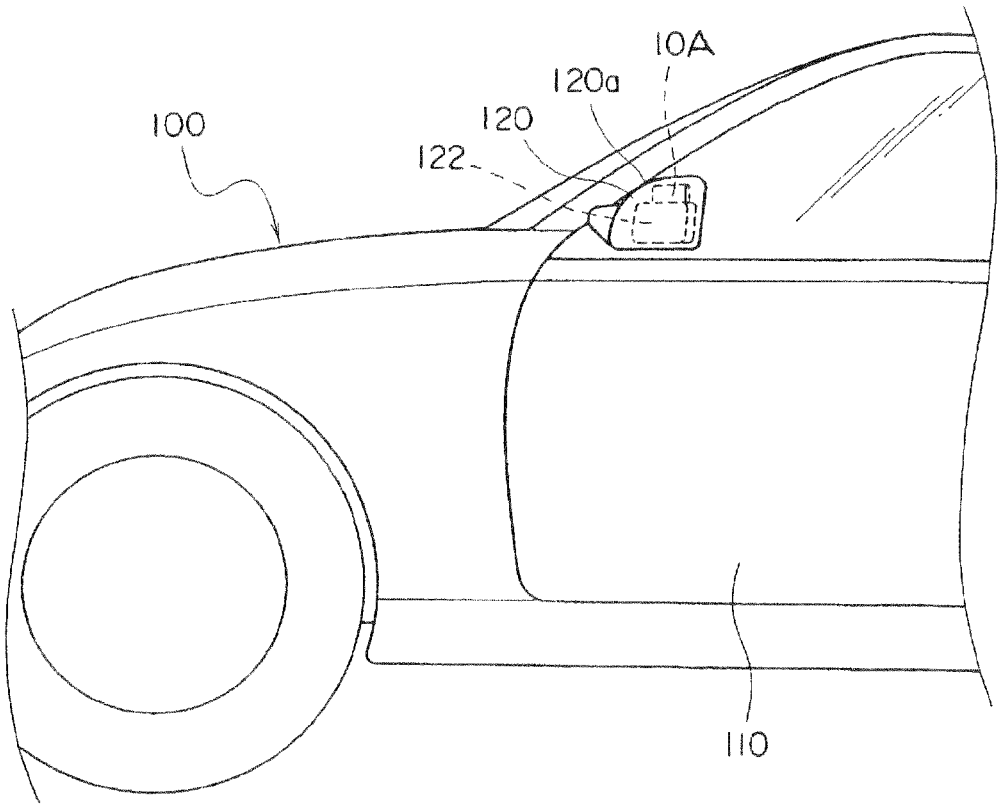
FIG. 2 is a side view showing a portion of an automobile to which an antenna unit according to this invention is applicable.

Referring now to FIG. 2, the description will proceed to an automobile to which this invention is applicable. The automobile depicted at 100 comprises a door 110 to which an outside mirror 120 is attached at the outside of the automobile 100.

The outside mirror 120 has an open/close structure which is adjustable to open and close it against a car body of the automobile 100. The outside mirror 120 comprises a cabinet 120*a* in which a motor 122 for opening and closing the outside mirror 120 in question and a motor drive (not shown) for driving the motor 122 are mounted. Accordingly, the cabinet 120*a* of the outside mirror 120 comprises a narrow-mounting-space cabinet.

Figure 3:
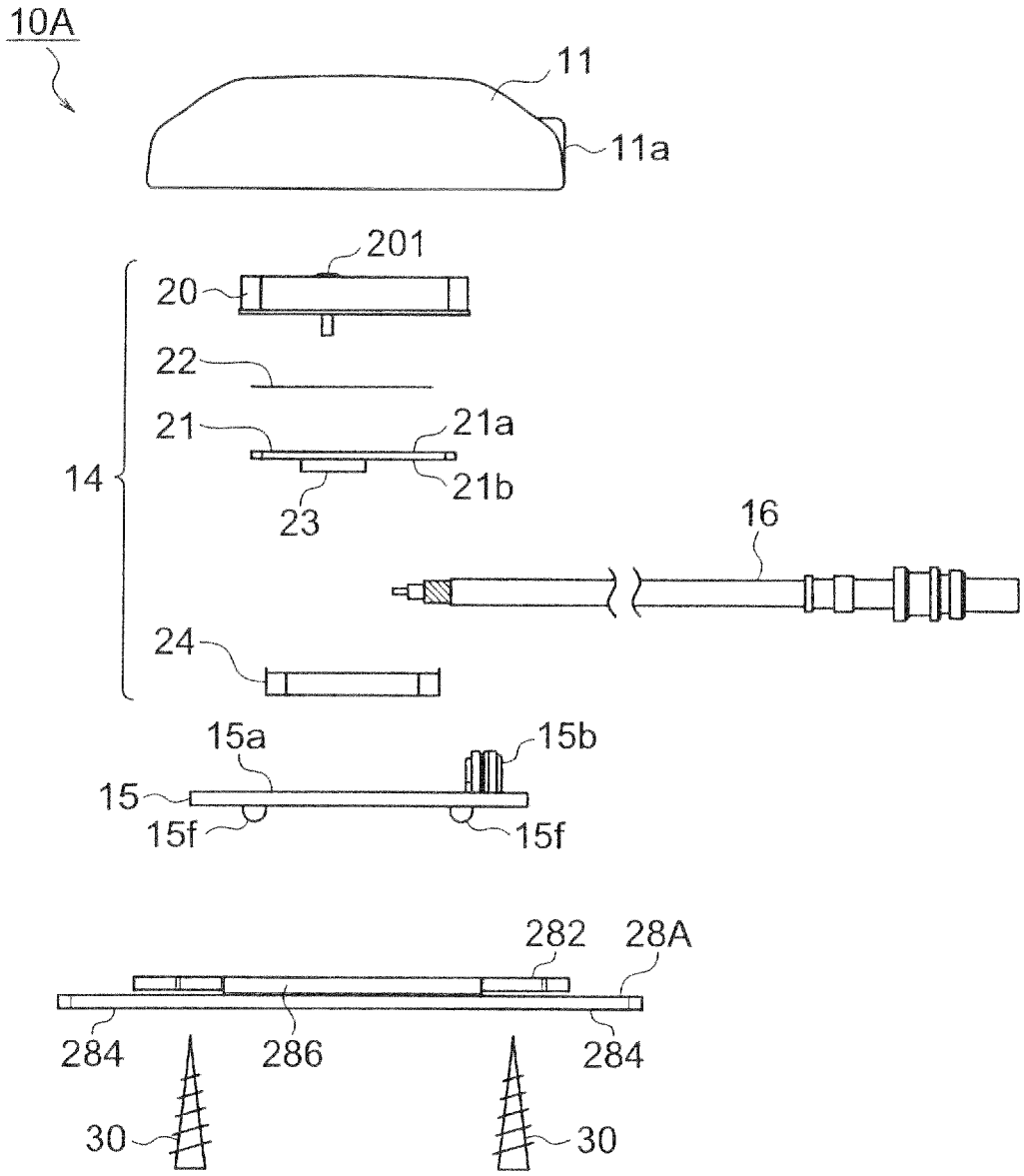
FIG. 3 is a schematic exploded view showing an antenna unit according to a first exemplary embodiment of this invention.
Figure 4D:
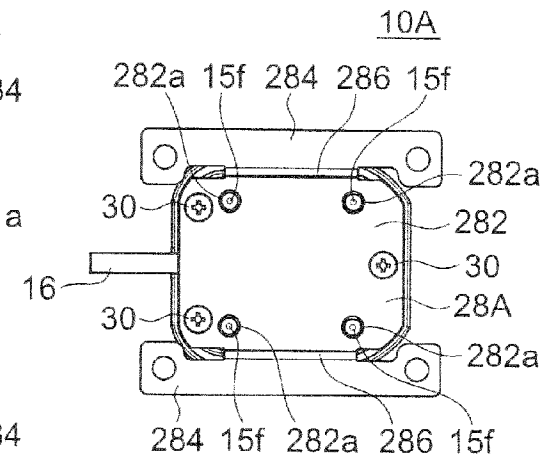
Figure 4C:
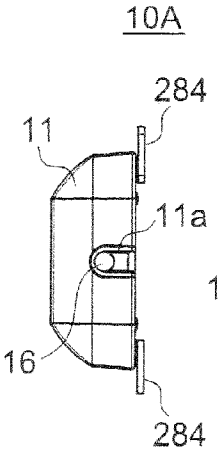
Figure 4A:
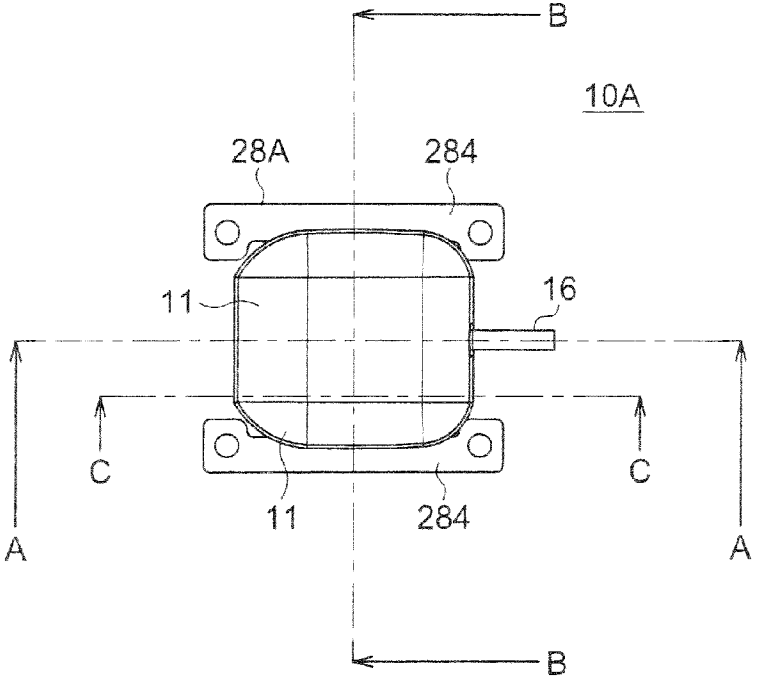
Figure 4B:
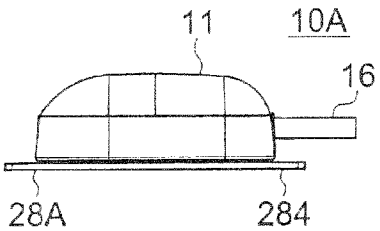

In the cabinet 120*a* of the outside mirror 120, an antenna unit 10A according to this invention is mounted at an upper portion of the motor 122. That is, the illustrated antenna unit 10A comprises an outside mirror housed antenna unit Referring to FIGS. 3, 4A to 4C, 5A to 5C, 6, and 7, the description will proceed to the antenna unit 10A according to a first exemplary embodiment of this invention. FIG. 3 is a schematic exploded view showing the antenna unit 10A. FIGS. 4A to 4C are views showing the antenna unit 10A, wherein FIG. 4A is a plan view of the antenna unit 10A, FIG. 4B is a front view of the antenna unit 10A, FIG. 4C is a right side view of the antenna unit 10A, and FIG. 4D is a bottom view of the antenna unit 10A.

Figure 5B:
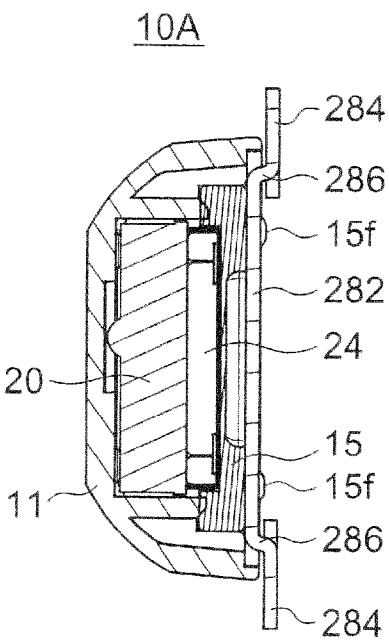
Figure 5A:
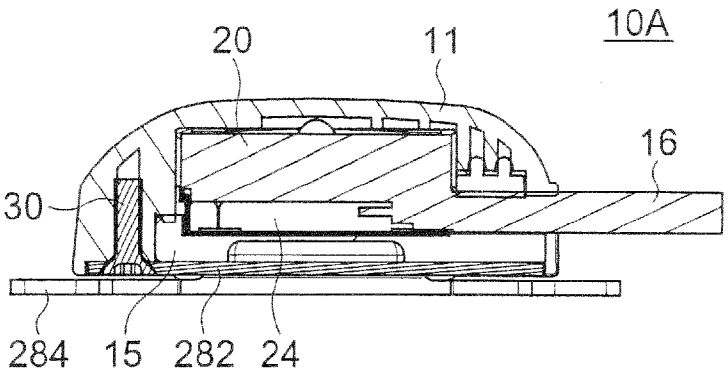
Figure 5C:
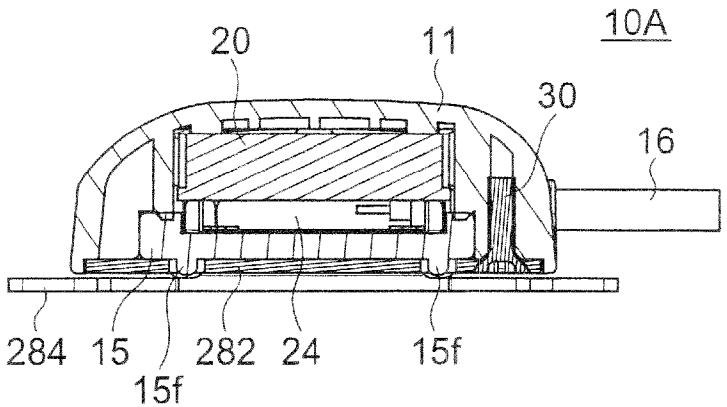
FIG. 5C is a sectional view taken along line C-C in FIG. 4A.
Figure 6:
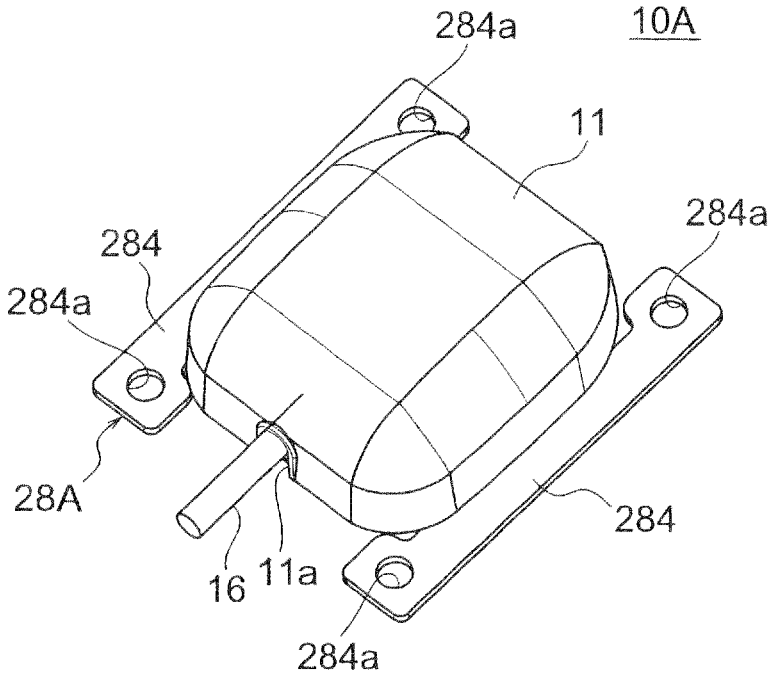
FIG. 6 is a perspective view showing a state where the antenna unit illustrated in FIG. 3 is seen from a slanting upward direction.
Figure 7:
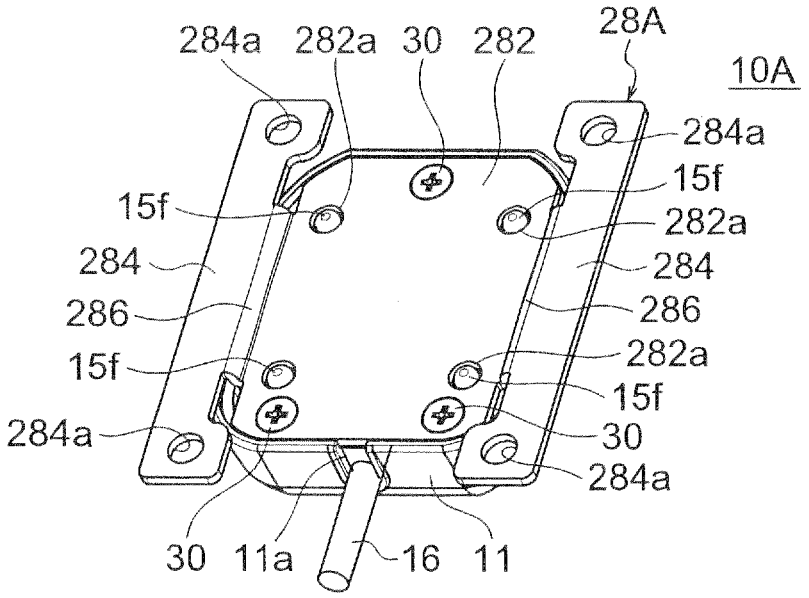
FIG. 7 is a perspective view showing a state where the antenna unit illustrated in FIG. 3 is seen from a slanting downward direction.

FIGS. 5A to 5C are sectional views showing the antenna unit 10A, wherein FIG. 5A is a sectional view taken on line A-A of FIG. 4A, FIG. 5B is a sectional view taken on line B-B of FIG. 4A, and FIG. 5C is a sectional view taken on line C-C of FIG. 4A. FIG. 6 is a perspective view showing a state where the antenna unit 10A is seen from a slanting upward direction. FIG. 7 is a perspective view showing a state where the antenna unit 10A is seen from a slanting downward direction.

The illustrated antenna unit 10A is similar in structure to the related antenna unit 10 illustrated in FIG. 1 except that the bottom plate 12 and the three screws 26 are omitted and the bracket is modified from that illustrated in FIG. 1 as will later become clear. The bracket is therefore depicted at 28A. Components having functions similar to those illustrated in FIG. 1 are depicted at the same reference symbols and overlapped description will be omitted for the sake of simplification of the description.

Although a detailed structure of the bracket 28A will later be described with reference to drawings, the bracket 28A comprises a bottom portion 282 and a mounting portion 284. The bottom portion 282 pressure welds the packing member (the gasket) 15 between it and the top cover 11 to make the inside of the top cover 11 an enclosed space. The mounting portion 284 is integrated to the bottom portion 282 to enable the antenna unit 10A in question to mount in the above-mentioned narrow-mounting-space cabinet 120*a*.

By directly mounting the bracket 28A to the top cover 11 by the use of three screws 30 (two screws only are illustrated in FIG. 3) in a state where the packing member (the gasket) 15 is sandwiched between the top cover 11 and the bracket 28A, the packing member (the gasket) 15 is pressure welded to serve the waterproofing function.

Specifically, the bottom portion 282 of the bracket 28A acts as the bottom plate 12 (see FIG. 1) of the related antenna unit 10. In other words, the illustrated bracket 28A has a structure where the bottom plate 12 and the bracket 28 in the related antenna unit 10 are integrated with each other. As a result, it is possible to omit the bottom plate 12 and the three screws 26 which are required in the related antenna unit 10. Accordingly, it is possible to decrease the number of parts and to decrease the number of mounting.

Figure 8:
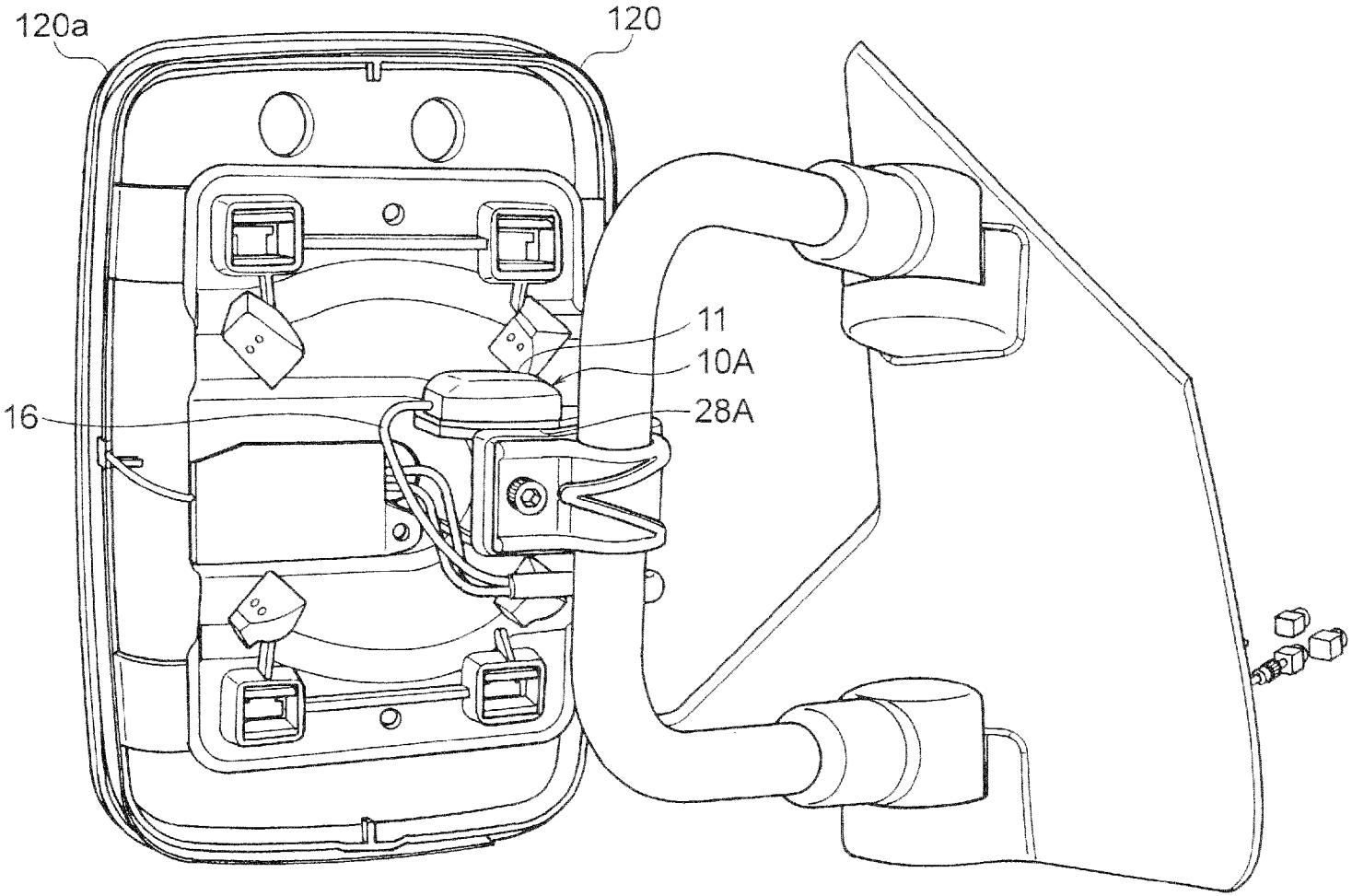
FIG. 8 is a view showing a state where the antenna unit illustrated in FIG. 3 is accommodated in a cabinet of an outside mirror of the automobile.

FIG. 8 shows a state where the antenna unit 10A is accommodated in the cabinet 120*a* of the outside mirror 120 of the automobile 100. The antenna unit 10A is accommodated in the cabinet 120*a* of the outside mirror 120 so that the top cover 11 thereof is turned to an upper direction.

Figure 9E:
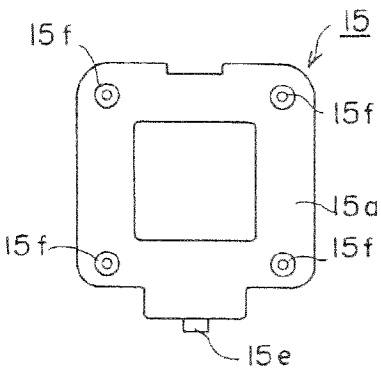
Figure 9C:
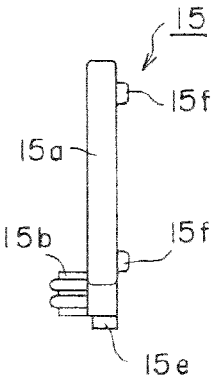
Figure 9D:
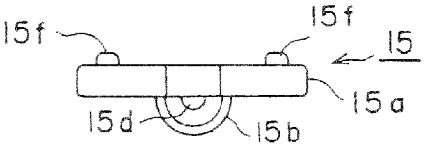
Figure 9A:
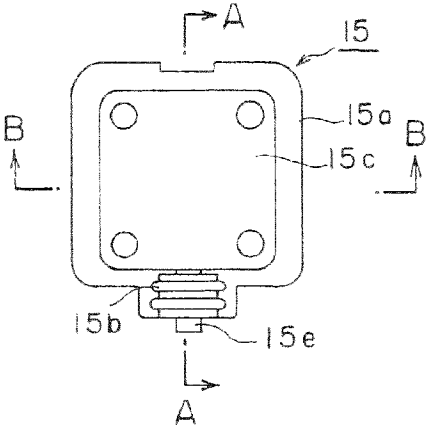
Figure 9B:
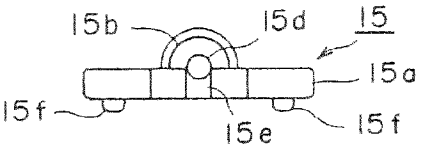
Figure 9G:
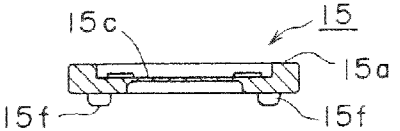
Figure 9F:
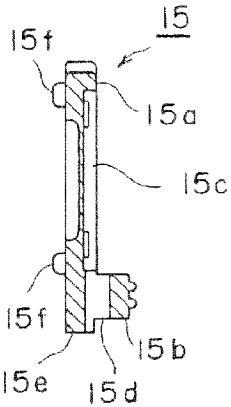

Referring to FIGS. 9A to 9G, the structure of the packing member (the gasket) 15 will be described in further detail. FIG. 9A is a plan view of the packing member (the gasket) 15, FIG. 9B is a front view of the packing member (the gasket) 15. FIG. 9C is a right side view of the packing member (the gasket) 15, FIG. 9D is a rear view of the packing member (the gasket) 15, FIG. 9E is a bottom view of the packing member (the gasket) 15, FIG. 9F is a sectional view taken along line A-A in FIG. 9A, and FIG. 9G is a sectional view taken along line B-B in FIG. 9A.

The base portion 15*a* has a concave portion 15*c*. Positioning of the antenna module 14 is carried out by the concave portion 15*c*. The concave portion 15*c* has a shape that covers substantially the whole bottom surface of the antenna module 14.

The gasket portion 15*b* is formed so as to rise from the base portion 15*a* at the position corresponding to the cutout portion 11*a* of the top cover 11. The gasket portion 15*b* has a hole 15*d* at its center portion for insertion of the signal line (the coaxial cable) 16 therethrough.

The packing member (the gasket) 15 has a convex portion 15*e* extending outward from the lower side of the hole 15*d*. The convex portion 15*e* abuts on the lower side of the signal line (the gasket) 16 to thereby form a waterproof structure. The convex portion 15*e* is provided so as to be exposed to the outside from the cutout portion 11*a* of the top cover 11, thereby forming part of the surface of the antenna body. The packing member (the gasket) 15 further comprises four projecting portions (legs) 15*f* provided at the lower surface of the base portion 15*a*. These projecting portions (legs) 15*f* pass through the bracket 28A so as to be exposed from the bottom surface of the antenna body. These projecting portions 15*f* serve to prevent slippage of the antenna body when the antenna unit 10A is placed on the upper portion of motor 122 (FIG. 2).

Figure 10C:
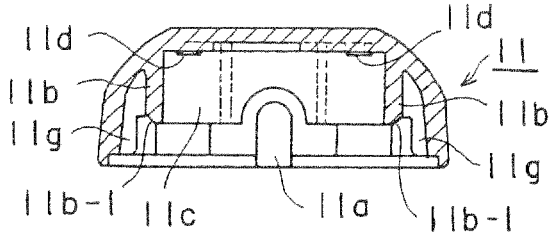
Figure 10B:
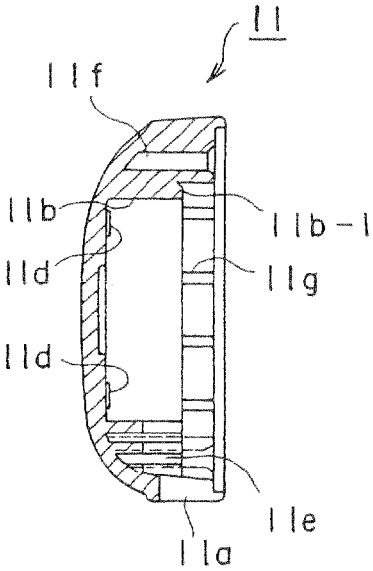
Figure 10A:
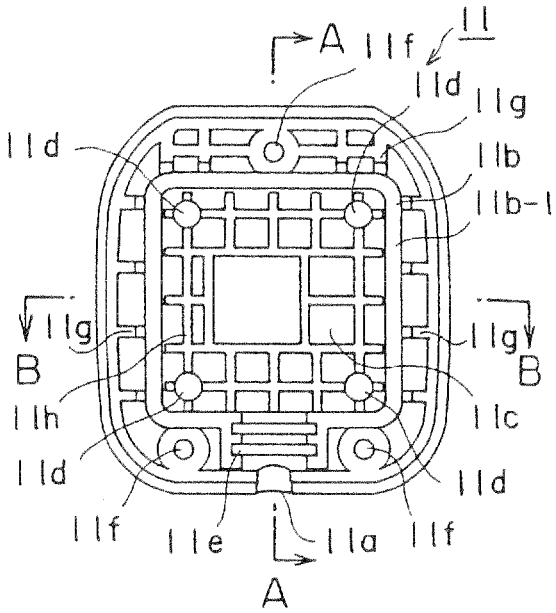

Referring to FIGS. 10A to 10C, the structure of the top cover 11 will be described. FIG. 10A is a bottom view of the top cover 11, FIG. 10B is a sectional view taken along line A-A in FIG. 10A, and FIG. 10C is a sectional view taken along line B-B in FIG. 10A.

The top cover 11 has a receiving portion 11*c* enclosed by a waterproofing rib 11*b* having a substantially rectangular cylinder shape. The receiving portion 11*c* receives the antenna module 14 of a box-shaped. In addition, inside of the receiving portion 11*c*, the top cover 11 is provided with four protrusion members 11*d* which are integrated to an inner wall top surface of the top cover 11. These protrusion members 11*d* are disposed at positions which abut on the antenna element 20 at about four corners thereof.

In addition, the top cover 11 has a casket receiving portion 11*e* for receiving the gasket portion 15*b* of the packing member 15 and three screw holes (screw bosses) 11*f* in which the three screws 30 are screwed, respectively.

As shown in FIG. 10C, the waterproofing rib 11*b* has a tip portion 11*b*-1 having an outer edge which is chamfered. The tip portion 11*b*-1 of the waterproofing rib 11*b* abuts on the packing member (the gasket) 15 by screwing the three screws 30 up.

Furthermore, in the top cover 11, twelve strengthening ribs 11*g* are formed around the waterproofing rib 11*b*. These strengthening ribs 11*g* are arranged (disposed) so as to match with the outside shape of the above-mentioned packing member (the gasket) 15. In other words, an imaginary shape which can imaginarily link tips of the strengthening ribs 11*g* is a shape which substantially corresponds to the outside shape of the packing member (the gasket) 15.

Figure 11B:
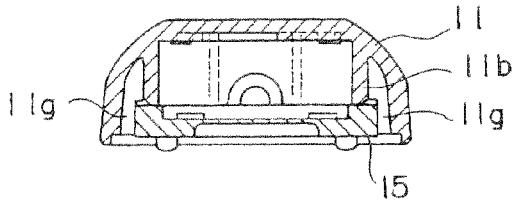
FIGS. 11A and 11B are views showing the state where the top cover illustrated in FIGS. 10A to 10C and the packing member illustrated in FIGS. 9A to 9G are combined together, where
Figure 11A:
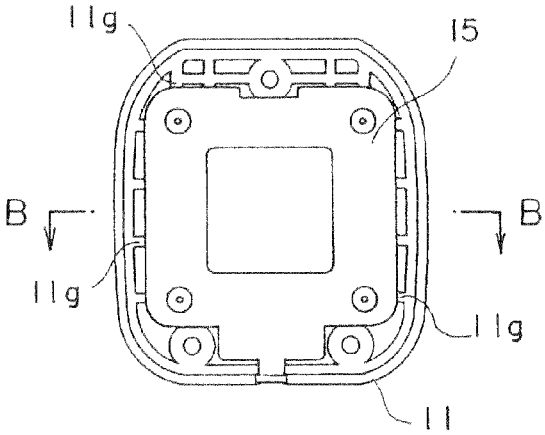

Therefore, as shown in FIGS. 11A and 11B, it is possible to easily position the packing member (the gasket) 15 with respect to the top cover 11. As a result, it is possible to improve workability. In addition, inasmuch as the packing member (the gasket) 15 and the bracket 28A are screwed to the top cover 11 up by means of the three screws 30, an upper outer end edge of the packing member (the bracket) 15 actually abuts on a substantially rectangular corner portion of the strengthening ribs 11*g* by a screwing-up pressure of the three screws 30 which is different from a state illustrated in FIGS. 11A and 11B.

In addition, in the inner wall top surface of the top cover 11, a lattice-shaped rib 11*h* is formed as shown in FIG. 10A. It is therefore possible to improve strength of the top cover 11. The lattice-shaped rib 11*h* is formed on the inner wall top surface of the receiving portion 11*c* enclosed by the substantially rectangular cylindrical shaped waterproofing rib 11*b* in the whole thereof except for a substantially rectangular shaped central portion. The substantially central portion from which the lattice-shaped rib 11*h* is removed is configured so that a feeding pin 201 (FIG. 3) projecting from the antenna element 20 to a receiving surface side thereof is positioned therein and serves as a clearance of the feeding pin 201 when the antenna element 20 is received in the receiving portion 11*c*.

Figure 12A:
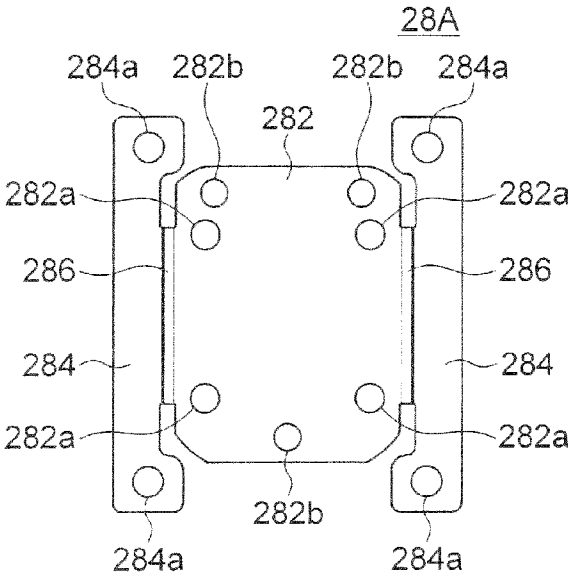
Figure 12C:
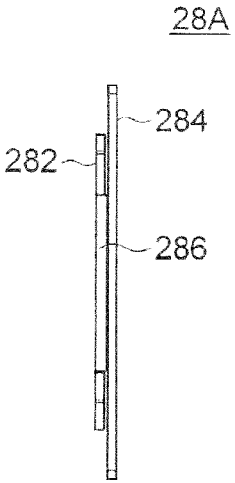
Figure 12D:
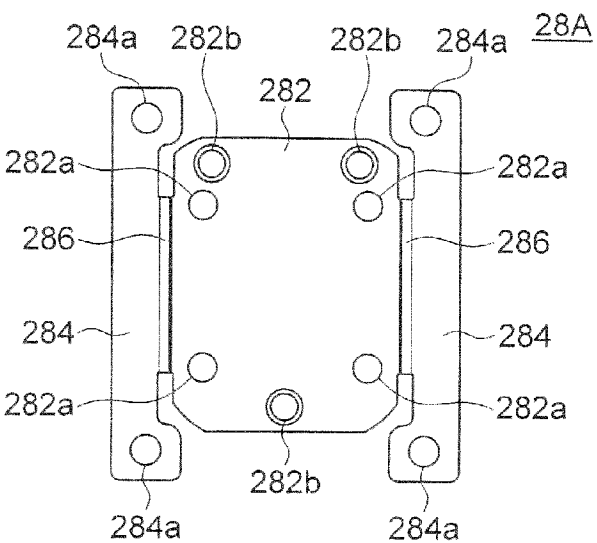
Figure 12B:
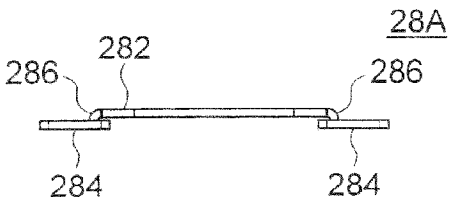
Figure 13:
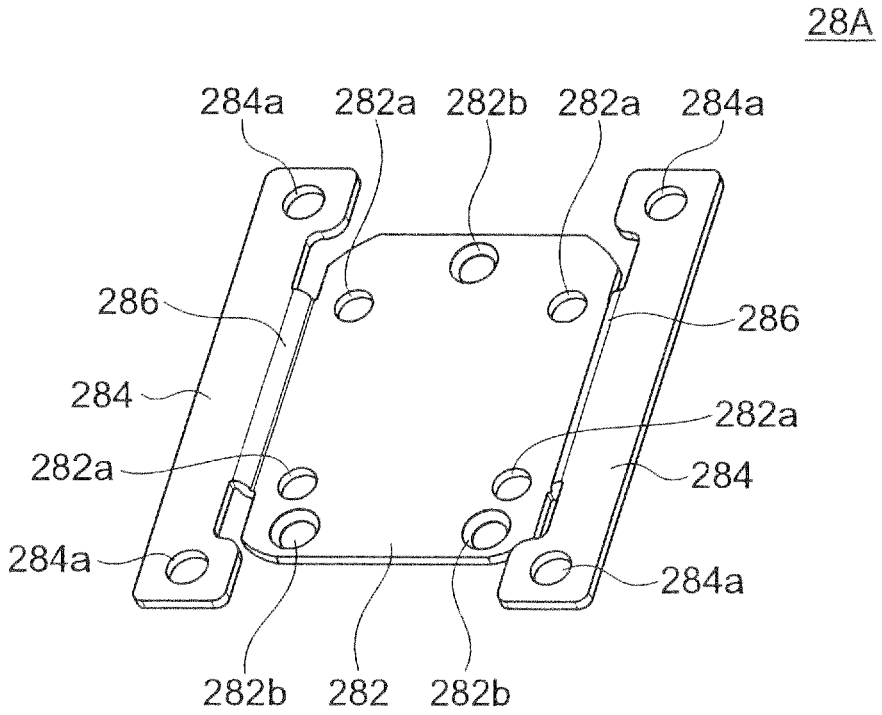
FIG. 13 is a perspective view showing a state where the bracket illustrated in FIGS. 12A to 12D is seen from a slanting downward direction.

Referring to FIGS. 12A to 12D and 13, the structure of the bracket 28A will be described. FIG. 12A is a plan view of the bracket 28A, FIG. 12B is a front view of the bracket 28A, FIG. 12C is a right side view of the bracket 28A, and FIG. 12D is a bottom view of the bracket 28A. FIG. 13 is a perspective view showing a state where the bracket 28A is seen from a slanting downward direction.

In the manner which is described above, the bracket 28A comprises the bottom portion 282 and the mounting portion 284. The mounting portion 284 is disposed on both sides of the bottom portion 282. The bottom portion 282 and the mounting portion 284 are coupled to each other by a pair of side coupling portions 286. The bottom portion 282 is formed from a forming surface of the mounting portion 284 upwards. In other words, the bottom portion 282 is formed at a bowed state upward from the forming surface of the mounting portion 284.

The bottom portion 282 is formed with four through holes 282*a* for allowing the above-mentioned four projecting portions (legs) 15*f* of the packing member (the basket) 15 to pass therethrough. The bottom portion 282 is further formed with three holes 282*b* for insertion of the three screws 30 therethrough.

As seen from FIGS. 4D and 7, the diameter of each through hole 282*a* of the bottom portion 282 is greater than that of each projecting portion (leg) 15*f* of the packing member (the gasket) 15

Further, the length of each projecting portion (leg) 15*f* is shortened to a degree such that even if the projecting portion (leg) 15*f* is elastically deformed laterally, the projecting portion (leg) 15*f* does not abut the edge of the through hole 282*a*. Further, as shown in FIG. 9B, the tip portion of each projecting portion (leg) 15*f* is R-shaped (rounded).

The mounting portion 284 has, at four corners thereof, four mounting holes 284*a* for mounting the antenna unit 10A in question in the narrow-mounting-space cabinet (the cabinet 120*a* of the outside mirror 120) by means of four screws (not shown).

Figure 14:
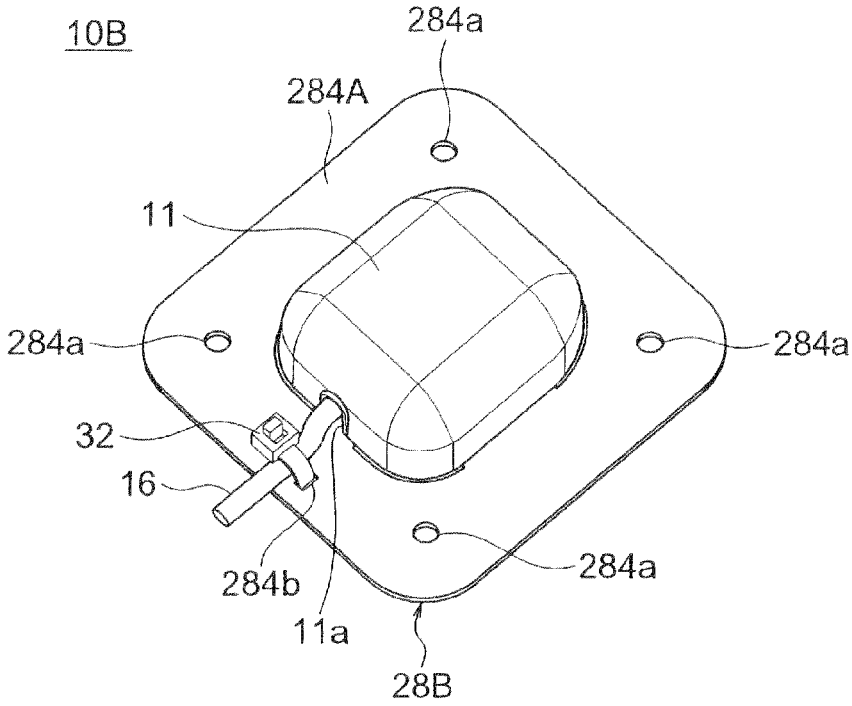
FIG. 14 is a perspective view showing a state where an antenna unit according to a second exemplary embodiment of this invention is seen from a slanting upward direction.
Figure 15:
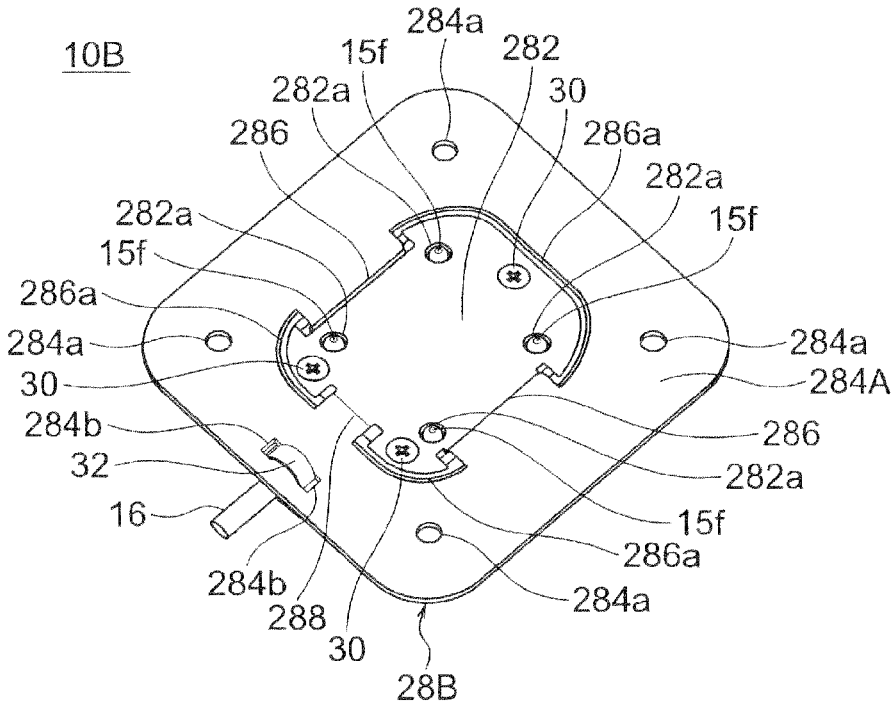
FIG. 15 is a perspective view showing a state where the antenna unit illustrated in FIG. 14 is seen from a slanting downward direction.

Referring to FIGS. 14 and 15, the description will proceed to an antenna unit 10B according to a second exemplary embodiment of this invention. FIG. 14 is a perspective view showing a state where the antenna unit 10B is seen from a slanting upward direction while FIG. 15 is a perspective view showing a state where the antenna unit 10B is seen from a slanting downward direction.

The illustrated antenna unit 10B is similar in structure to the antenna unit 10A illustrated in FIGS. 3 through 7 except that the bracket is modified from that illustrated in FIGS. 3 through 7 as will later become clear. The bracket is therefore depicted at 28B. Components having functions similar to those illustrated in FIGS. 3 through 7 are depicted at the same reference symbols and description of these components will be omitted for the sake of simplification of the description.

The bracket 28B is similar in structure to the bracket 28A illustrated in FIGS. 12 and 13 except that the mounting portion is modified from that illustrated in FIGS. 12 and 13 as will later become clear. The mounting portion is therefore depicted at 284A.

In the bracket 28A of the antenna unit 10A according to the first exemplary embodiment of this invention, the mounting portion 284 is disposed on both sides of the bottom portion 282. In comparison with this, in the bracket 28B of the antenna unit 10B according to the second exemplary embodiment of this invention, the mounting portion 284A is disposed at outer regions of the bottom portion 282.

In addition, in the bracket 28A of the antenna unit 10A according to the first exemplary embodiment of this invention, the bottom portion 282 and the mounting portion 284 are coupled to each other by the pair of side coupling portions 286. In comparison with this, in the bracket 28B of the antenna unit 10B according to the second exemplary embodiment of this invention, the bottom portion 282 and the mounting portion 284A are coupled to each other not only by the pair of side coupling portions 286 but also by an end coupling portion 288. The end coupling portion 288 is formed at a position corresponding to the cutout portion 11*a* of the top cover 11, namely, at a side out which the signal line (the coaxial cable) 16 is drawn.

As shown in FIG. 15, the bracket 28B has three slits 286*a* between the pair of side coupling portions 286 and the end coupling portion 288 at boundaries between the bottom portion 282 and the mounting portion 284A. In other words, the bracket 28B is manufactured by forming the three slits 286*a* in one sheet metal to serve a portion enclosed by these three slits 286*a* as the bottom portion 282. The bottom portion 282 is formed from a forming surface of the mounting portion 284A upwards. In other words, the bottom portion 282 is formed at a bowed state upward from the forming surface of the mounting portion 284A.

In addition, the mounting portion 284A has a pair of rectangular openings 284*b* at an end portion of the side out which the signal line (the coaxial cable) 16 is drawn. By passing a coupling cord 32 through the pair of rectangular openings 284*b*, the signal line (the coaxial cable) 16 is fixed on the mounting portion 284A.

In the afore-mentioned antenna unit according to the exemplary aspect of this invention, the bottom portion preferably may be formed at a bowed state upward from a forming surface of the mounting portion.

In the afore-mentioned antenna unit according to a first exemplary aspect of this invention, the mounting portion may be disposed on both sides of the bottom portion. In this event, the bottom portion and the mounting portion may be coupled to each other by, for example, a pair of side coupling portions.

In the afore-mentioned antenna unit according to a second exemplary aspect of this invention, the mounting portion may be disposed at outer regions of the bottom portion. In this event, the bottom portion and the mounting portion may be coupled to each other by, for example, a pair of side coupling portions and an end coupling portion. The bracket preferably may have three slits between the pair of side coupling portions and the end coupling portion at boundaries between the bottom portion and the mounting portion.

In the afore-mentioned antenna unit according to the first and the second exemplary aspects of this invention, the antenna unit may be, for example, mounted in, as the narrow-mounting-space cabinet, a cabinet of an outside mirror of an automobile. The antenna module may comprise a circuit board having an upper surface and a lower surface which are opposed to each other and mounting a signal processing circuit on the lower surface thereof, an antenna element mounted on the upper surface of the circuit board, and a shield case attached to the lower surface of the circuit board so as to cover the signal processing circuit. The gasket may be, for example, pressure inserted in a state where the gasket is sandwiched between the top cover and the bottom portion of the bracket by tightening the gasket by the use of a plurality of screws. The antenna unit may be either adapted to receive GPS signals as the radio waves or adapted to receive SDARS signals as the radio waves.

An exemplary advantage according to the invention is that it is possible to decrease the number of parts and to decrease the number for mounting. This is because the bracket is directly mounted to the top cover to pressure insert the gasket therebetween, thereby serves as a waterproofing function. It is therefore possible to eliminate the need to a bottom plate and a plurality of screws which are required to a conventional antenna unit.

While this invention has been particularly shown and described with reference to exemplary embodiments thereof, the invention is not limited to these embodiments. It will be understood by those of ordinary skilled in the art that various changes in form and details by be made therein without departing from the sprit and scope of the present invention as defined by the claims. For example, the antenna unit described in the exemplary embodiments is suitable as an antenna unit for GPS signal reception, but not limited thereto, and is also applicable as an antenna unit for mobile communication adapted to receive other satellite waves such as SDARS signals, ground waves, or other radio waves.

What is claimed is:

1. An antenna unit comprising:

a dome-shaped top cover;

an antenna module disposed in said top cover and adapted to receive radio waves;

a bracket covering an under surface of said top cover; and a gasket disposed between said top cover and said bracket to hermetically seal said top cover, wherein said bracket consists of one piece and comprises:

a bottom portion pressure welding said gasket between said bottom portion and said top cover to form an enclosed space inside of said top cover, said bottom portion and said gasket being disposed at an inside of an inner wall face of said top cover, a mounting portion integrated to said bottom portion for mounting said antenna unit in a cabinet, said mounting portion being disposed at an outside of said bottom portion so as to extend from said bottom portion outward beyond said top cover; and a coupling member for coupling said bottom portion with said mounting portion, wherein said bottom portion is formed in a bowed state upward from a forming surface of said mounting portion.

2. An antenna unit as claimed in claim 1, wherein said mounting portion comprises first and second portions respectively disposed on first and second sides of said bottom portion.

3. An antenna unit as claimed in claim 2, wherein said coupling member comprises first and second side coupling portions, and wherein said bottom portion and said first and second portions of said mounting portion are coupled to each other by said first and second side coupling portions, respectively.

4. An antenna unit as claimed in claim 2, wherein said first and second portions of said mounting portion are disposed at outer regions of said bottom portion.

5. An antenna unit as claimed in claim 4, wherein said coupling member comprises first and second side coupling portions and an end coupling portion, and wherein said bottom portion and said first and second portions of said mounting portion are coupled to each other by said first and second side coupling portions, respectively, and said bottom portion and said mounting portion are also coupled to each other by said end coupling portion.

6. An antenna unit as claimed in claim 5, wherein said bracket comprises three slits respectively provided between said first and second side coupling portions and said end coupling portion at boundaries between said bottom portion and said mounting portion.

7. An antenna unit as claimed in claim 1, wherein said cabinet in which said antenna unit is mountable is an outside mirror of an automobile.

8. An antenna unit as claimed in claim 1, wherein said antenna module comprises:

a circuit board having an upper surface and a lower surface which are opposed to each other;

a signal processing circuit mounted on the lower surface of said circuit board;

an antenna element mounted on the upper surface of said circuit board; and a shield case attached to the lower surface of said circuit board so as to cover said signal processing circuit.

9. An antenna unit as claimed in claim 1, wherein said gasket is pressure inserted in a state where said gasket is sandwiched between said top cover and said bottom portion of the bracket by tightening said gasket via a plurality of screws.

10. An antenna unit as claimed in claim 1, wherein said antenna unit is adapted to receive GPS signals as the radio waves.

11. An antenna unit as claimed in claim 1, wherein said antenna unit is adapted to receive SDARS signals as the radio waves.

* * * * *